United States Patent [19]

LaPointe

[11] 3,962,966

[45] June 15, 1976

[54] CHIP CRUSHER

[75] Inventor: Joseph A. LaPointe, Pointe Claire, Canada

[73] Assignee: Domtar Limited, Montreal, Canada

[22] Filed: Mar. 3, 1975

[21] Appl. No.: 554,985

[52] U.S. Cl. ..... 100/156; 100/173; 100/210; 241/117

[51] Int. Cl.[2] ..... B30B 3/02

[58] Field of Search ..... 241/117; 100/121, 156, 100/173, 210

[56] References Cited

UNITED STATES PATENTS

| | | | |
|---|---|---|---|
| 588,125 | 8/1897 | Bundren | 100/156 |
| 736,217 | 8/1903 | Clark | 100/156 X |
| 1,110,222 | 9/1914 | Morat | 241/117 |
| 3,792,655 | 2/1974 | Caddell et al. | 100/210 X |

*Primary Examiner*—Billy J. Wilhite
*Attorney, Agent, or Firm*—C. A. Rowley

[57] ABSTRACT

A chip crusher composed of a rotating disc and at least one crushing roller mounted to form a nip with a working face of the disc adjacent the periphery of the disc. The chips pass through an inlet and engage the rotating disc which flings them towards the periphery of the disc thereby to spread chips into a substantially single thickness layer. Each chip moves with the disc into the nip between the roller and disc wherein the chip is crushed. The crusher fissures the chip to a degree substantially proportional to the original chip thickness and thereby produces crushed chips having more uniform pulping qualities than regular chips.

18 Claims, 9 Drawing Figures

CHIP CRUSHER

FIELD OF THE INVENTION

The present invention relates to a device for crushing and thereby fissuring chips to improve their ability to absorb cooking chemical in the process of producing wood pulp suitable for making paper. More specifically the present invention relates to a disc type apparatus for spreading and crushing wood chips thereby to fissure the wood chips and form them into particles having more uniform pulping characteristics.

DESCRIPTION OF THE PRIOR ART

The concept of crushing chips to improve their pulping characteristics is not new. This concept was discussed in the patent literature as early as February 1904 in Canadian Patent No. 89076 issued to Gist and more recently for example in U.S. Pat. No. 3,406,624 issued Oct. 22, 1968 to Kutchera et al.

U.S. Pat. Nos. 3,189,066 and 3,093,524 issued June 15, 1965 and June 11, 1963 respectively to Flamant teaches formation of uniform size wood particles by crushing to liberate fragments.

Canadian Pat. No. 773,835 issued Dec. 19, 1967 to Blackford describes a system wherein wood chips are compressed between a pair of rotating compression rolls thereby to compress the chips to a small fraction of their original thickness without damage to the fibers.

It has also been proposed to separate bark from chips by crushing in Canadian Pat. No. 839,549 issued April 21, 1970 Lloyd et al. This operation is similar to the crushing operating discussed in Canadian Pat. No. 773,835 to Blackford in that a pair of rolls are used to crush the chip with bark thereon and thereby cause separation of the bark from the chip.

None of the above described systems provide compact yet high capacity equipment and the concept of crushing the chips to improve their pulping characteristics is not being practised commercially on a large scale.

SUMMARY OF THE INVENTION

Broadly the present invention comprises a disc rotatable on an axis, an entry passage for feeding chips to said disc adjacent said rotational axis, at least one roll mounted for rotation about its longitudinal axis, said roll cooperating with an annular area of the face of said disc to form a nip, means to fling said chips outward of said disc thereby to spread said chip into a single layer before said chips enter said nip.

Preferably spaced substantially radial ridges project from said face of said disc toward said plate and function to force chips through said nip between said roll and said face of said disc.

BRIEF DESCRIPTION OF THE DRAWING

Further features, objects and advantages will be evident from the following detailed description of a preferred embodiment of the present invention taken in conjunction with the accompanying drawings in which.

DESCRIPTION OF THE PREFERRED EMBODIMENT

Figure 1:
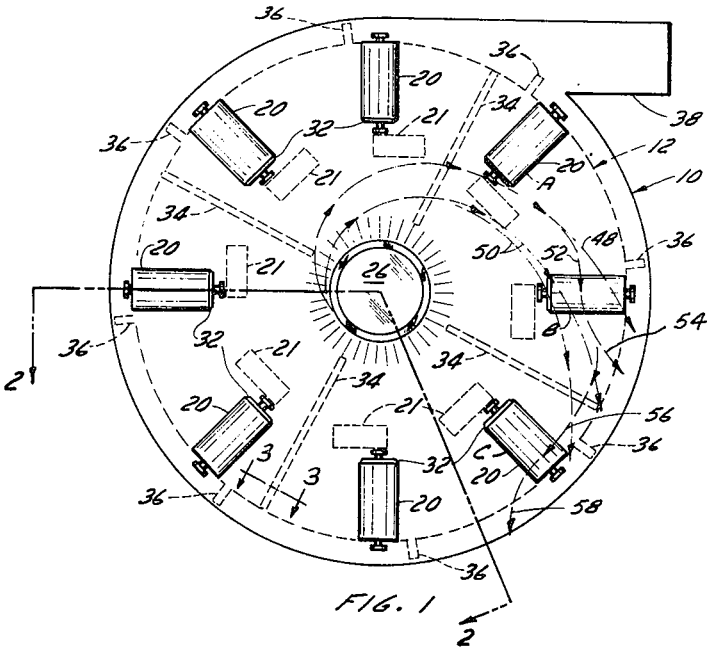
FIG. 1 is a schematic plan view with parts omitted of the chip spreader and crusher of the present invention showing the revolving disc in dash lines.

In the various embodiments like reference numerals have been used to represent, like parts.

The present invention is similar to a conventional disc refiner in that it includes a housing 10 and a rotating disc 12 driven from a suitable power source (not shown) through the axle 14. (See FIG. 2). The working face 16 of the disc 12 co-operates with the opposed inner surface 18 of the housing 10 in some embodiments as will be described in more detail hereinbelow:

A plurality of rolls 20 (in the illustrated arrangement eight substantially cylindrical rolls have been provided but the optimum number will vary depending on the length of the rolls, size of the disc and its angular velocity). Rolls 20 are positioned adjacent the outer periphery of the disc 16 and may be mounted for free rotation or driven by suitable drive mechanisms 21 which have been outlined in dot-dash lines since they are not essential. The rolls 20 have their peripheral surfaces 24 substantially parallel to the working face 16 and co-operate with an annular area defined on the surface 16 between the minimum and maximum radial spacing of the rolls 20 from the rotational axis of the disc 12. The rolls 20 form a plurality of nips 22 between the face 16 and the periphery 24 of the rolls.

A chip inlet 26 substantially co-axial with the axis of rotation of the disc 12 is formed in the housing 10. The inlet 26 has been shown aligned with the axis of the disc but it may be desirable to make it annular so that the chips entering the apparatus contact the disc 12 or flinger 28 (if provided) at a radial distance spaced from its axis of rotation. The flinger 28 may be independently driven via shaft 29 and its speed regulated to propell the chips radially outward on the disc 12 as will be described hereinbelow.

Figure 2:
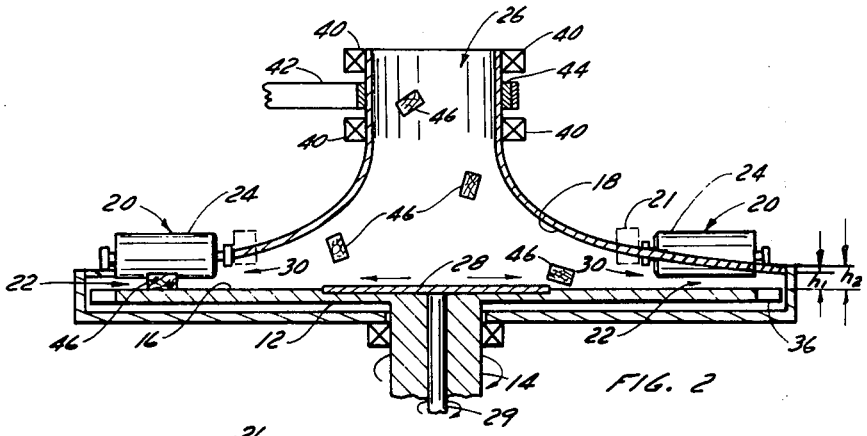
FIG. 2 is a section on the lines 2—2 of FIG. 1.

The gap 30 between the working face 16 of the disc 12 and the inner surface 18 of the housing 10 in the FIG. 2 embodiment tapers to a minimum height $h_1$ at a radial spacing from the axis of rotation of the disc 12 substantially equal to that of the end of the rolls 20 closest to the periphery of the disc. Preferably the height of the gap $h_2$ at the end of the rolls closest to the axis of rotation will be slightly greater than the maximum thickness chip to be crushed by the rolls 20. The minimum height $h_1$ will be substantially equal to the height of the nips 22. The gap 30 preferably will increase in height as the axis of rotation of the disc 12 is approached, however, the operative section of the gap overlies the annular area of the disc 12 with which the rolls 20 co-operate to form the nips 22 and it is the shape of this section that tapers from $h_2$ to $h_1$.

The diameter of the rolls 20 is important. It has been found that if these rolls are too large in diameter proper operation will not be obtained. The diameter of the rolls when chips are to be processed should be between one and ten inches and preferably will be in the range of about 3 to 5 inches. Preferably the rolls will be short i.e. the longitudinal length of the rolls will preferably be between about 4 and 12 inches.

The end of each roll 20 closest to the axis of rotation of the disc 12 is tapered (conical) as indicated at 32. This taper 32 as shown in FIG. 1, tends to prevent the chips jamming the equipment.

Figure 3:
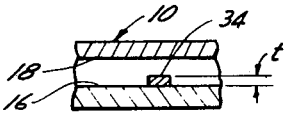
FIG. 3 is a section on the lines 3—3 of FIG. 1.

The disc 12 has a plurality of projections 34 in the form of radial ridges extending upwardly from the working surface 16 as shown in FIGS. 1 and 3. These ridges project above the surface of the disc to a height which is less than about two-thirds the height of the nip 22. In the illustrated arrangement four such projection 34 have been provided, however, if desired there may be more or fewer of these projections.

A plurality of blades 36 may be provided at the outer periphery of the disc 12 to throw the processed chips out through the tangential outlet 38. The blades 36 also may induce an air flow through the inlet 26, gap 30 and out through outlet 38.

If desired, the device may be fashioned as double disc refiner equipment. In this case the upper part of the housing 10, i.e. the part of the housing incorporating the surface 18 and extending outwardly to about the peripheral edge of the disc 12 may be rotated on bearings 40 via a drive schematically illustrated by the belt 42 and pulley 44. The double disc arrangement may also be used for example with the FIGS. 5 and 6 embodiment.

The equipment of the FIGS. 1 to 3 embodiment operates as follows:

Wood chips 46 are introduced via the inlet 26, contact flinger 28 and are flung radially outward into the gap 30. If the flinger 28 is omitted the chips directly contact the disc 12 preferably on a slightly raised surface and are thrown into the nips 22. The flinger 28 permits adjustment of the chips trajectory. Preferably the rate of feed of chips through the inlet 26 is correlated with the rate in which they are flung outwardly to prevent accumulation of chips i.e. the chips are moved from the fligner 28 at least as fast as they arrive.

Each chip is flung radially outward into the gap 30 and passes beneath at least one of the rollers 20. The trajectory of the chips will vary depending on their thickness as the tapering gap 30 traps chips of various thicknesses at different positions along the gap. However, unimpeded chip trajectories preferably will be as indicated for example by the arrows 48 and 50 so that if the chip just missed one of the rolls 20, i.e. the roll 20-A as indicated by the arrows 48 it will just pass under the roll 20-B adjacent the end of the roll 20-B remote from the axis of rotation of the disc. Alternatively, if the chip just passed under a roll 20, say roll 20-B, as indicated by arrow 50 it would just pass by the outer extremity of the next roll 20-C in the sequence so that theoretically a chip could only pass under a roll once. These trajectories are not absolutely essential to the instant invention but provide an optimum mode of operation and preferably the feed will be correlated to obtain maximum production in this manner. If desired, the equipment may be designed to press at least some of the chips more than once.

As above indicated chips of a size that are to be compressed will be caught in the tapering gap 30 of the FIGS. 1 to 4 embodiment at the height of the gap equivalent to the thickness of the chip. At this point the chips will follow an arcuate path with the disc as indicated by the arrow 52 and after passing under the roll 20-B will follow the trajectory designated by the arrow 54 until it reaches the periphery of the disc.

When chips pass through a nip 22 and are compressed they tend to spring back and approach their original thickness. The crushing action fissures the chips by cracking them along the fibre boundaries thereby to expose more surface area to facilitate their impregnation with cooking chemical during the pulping operation. Should the chip expand before it reaches the periphery of the disc 12 it will again be trapped in the gap 30 and will follow a second accurate path on a larger radius than the first such as that illustrated at 56 in FIG. 1 until it passes beneath the next roll 20-C in the sequence and will then follow the trajectory 58 to the edge of the disc. The maximum number of rolls under which a chip will normally pass generally will not exceed about 4. Preferably the length of the rolls 20 in the radial direction relative to the disc 12 will be correlated with the speed of the disc, rate of recovery (expansion) of the wood, etc. to ensure that the wood is not overworked.

To facilitate escape of the chips after they have been compressed the periphery of the disc 12 should not extend significantly beyond the end of the rolls 20 remote from the axis of rotation of the disc.

The projections or ridges 34 ensure positive movement of any chip that tends to hang up in the gap 30 and forces these chips through the nips 22 so that they are properly reduced and pass through the device.

If the rolls 20 are driven via drive mechanisms 21 they should be driven in a direction tending to pull chips in to the nips 22 in the direction of movement of the chips, i.e. the peripheral surface of the rolls 20 will move in substantially the same direction as the surface of the disc 12 as they approach the nip 22.

The chips 46 enter via inlet 26; are flung out into a single layer relationship; pass through the nips 22 and the crushed chips are propelled by the veins 36 through the outlet 38.

It will be apparent that when the flinger 28 is used and is driven independently by the shaft 29 trajectories of the chips may change after they pass through a nip 22 since the trajectory after the nip is determined by the angular of velocity of the disc 12 while the trajectory entering the nip 22 is determined by the angular of velocity of the flinger 28.

Figure 4:
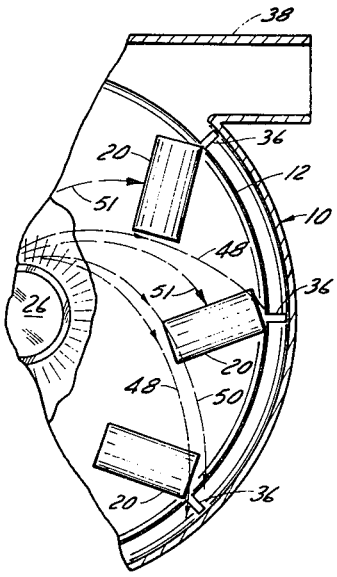
FIG. 4 is at a partial plan view similar to FIG. 1 illustrating a further modification of the instant invention.

The rotational axis of the rolls 20 need not be substantially radial to the axis of rotation of the disc as shown in FIGS. 1 – 3 inclusive but may be oriented at any other suitable angle, for example at the angle, indicated by rolls 20 in FIG. 4. In this figure the axis of the rolls 20 are oriented substantially perpendicular to the free trajectory of a chip that would engage each roll 20 midway of its length i.e. as indicated by the arrow 51. Orientation of the rolls at any suitable angle is not critical to the embodiment of FIGS. 1 – 4 inclusive or to the embodiments illustrated in the remaining figures.

In the FIG. 4 embodiment the drive mechanisms 21 have not been illustrated, however, such drive mechanisms may be provided if desired.

Figure 5:
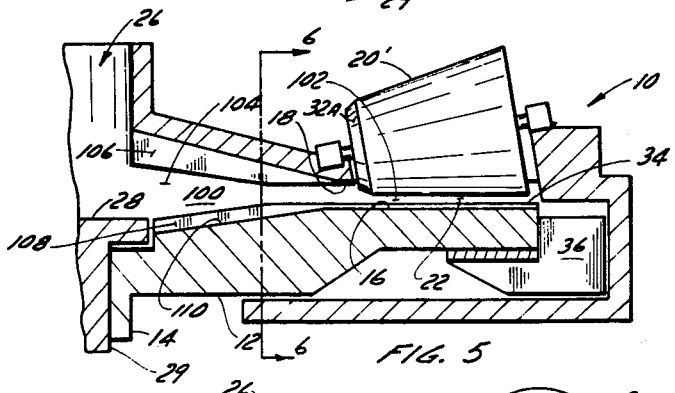
FIG. 5 is a partial section view similar to FIG. 2 but illustrating a preferred embodiment of the present invention incorporating breaker bars.
Figure 6:
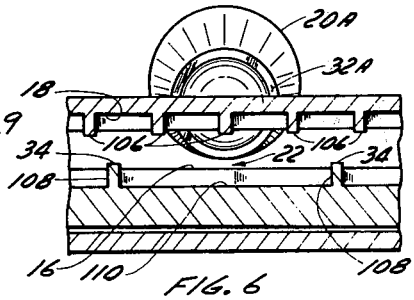
FIG. 6 is a section along the line 6—6 in FIG. 5.

FIGS. 5 and 6 schematically illustrate the preferred arrangement of the present invention. In these figures the device has been shown to a different scale and in more realistic proportions than in the other figures.

As seen in FIGS. 5 and 6 the inlet 26 directs chips on to the flinger 28 and these chips are thrown into the gap 100 which is divided into a nip section 102 where the rolls 20′ cooperate with the surface 16 to form the nips 22 and a tapering lead in or breaker section 104. In the breaker section 104 the housing 10 is provided with breaker bars 106 which cooperate with the extensions 108 of the projections or ridges 34 on the disc 12 to reduce oversize chips much in the manner of the breaker bars on refiner plates.

Preferably the surface of the disc 12 in the lead in or breaker section 104 will slope upwardly from the upper surface of the flinger 28 as indicated at 110. The slope of the surface 110 tends to orient the chips relative to the disc 12 so that the chips enter the nips 22 with their major surfaces parallel to the surface 16 of the disc.

The rollers 20' in this embodiment are conical and are arranged with their smaller diameter end closest to the axis of rotation of the disc. Preferably the cone angle of the conical roller 20' will be such that the peripheral speed of any point of the periphery of the roller will increase as it is moved radially outward relative to the axis of rotation of the disc at the same rate as the speed of a second point on the disc, at the same radius from the axis of rotation of the disc as said any point, increases as it is moved outward. By designing and mounting the conical roller 20' in this manner, when two chips pass through a nip 22, a minimum of polishing action will be applied to the chips i.e. there will be substantially no relative movement between the surface of the roll and the chip due to difference in the speeds of the two spaced chips contacting the roll simultaneously. Generally to obtain this relationship when the longitudinal axis of the roller (axis of rotation) radial relative to the axis of rotation of the disc, the roller axis is aligned with the apex of the surface generated by the surface 16 of the disc i.e. a point on the axis of rotation of the disc. While this conical shape of the rollers 20' is not essential, it does improve operation.

The small diameter end of the roll 20' may be tapered as indicated at 32A for the same reason that the cylindrical rolls 20 of the previous embodiments were tapered as indicated in 32.

The conical rollers may if desired be used in any of the disclosed embodiments of the invention.

The operation of the FIGS. 5 and 6 embodiment is essentially the same as the FIGS. 1 to 3 inclusive embodiment with the exception that the gap 100 does not taper in the operative section 102, i.e. in the section overlying the annular area of the surface 16 forming the nips 22 with the rollers 20'. Thus in this arrangement chips will all follow their normal trajectory (unless the chips are oversized and worked on by the breaker bars 106) and the trajectories are correlated (by speed of rotation of the flinger 28 and the disc 12) to ensure that a chip passes through at least one of the nips 22 before leaving the periphery of the disc 12 and are flung out of the crusher through exit 38 by the paddles or blades 36. The peripheral speed of the roller 20' at any point may be at the same speed as a point on the disc 12 spaced the same distance from the axis of the disc.

Figure 9:
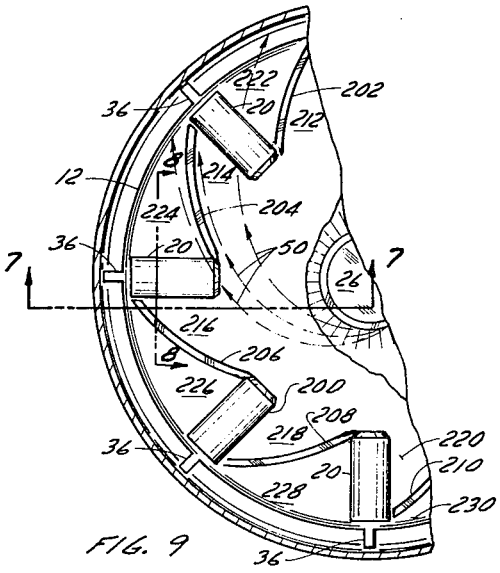
FIG. 9 is a section along the line 9—9 of FIG. 7.
Figure 7:
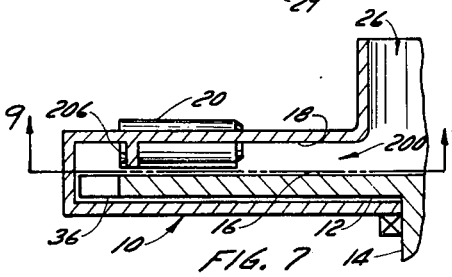
FIG. 7 is a section along the line 7—7 of FIG. 9 illustrating another embodiment of the present invention.
Figure 8:
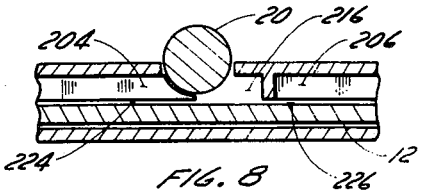
FIG. 8 is a partial section along the line 8—8 of FIG. 9.

Referring to FIGS. 7 to 9 inclusive it will be noted that the gap 200 between the face 18 of the housing and 16 of the disc 12 does not taper. The rolls 20 project into the gap 200 and form the nips 22 with the face 16 of the disc in the same manner as in the other embodiments.

In place of the tapering gap of the FIGS. 1 to 3 embodiment there is provided curved abuttments 202, 204, 206, 208 and 210, etc. one extending from the end of a leading roll 20 closest to the axis of rotation of the disc 12 to the end of a trailing roll 20 furthest from the axis of rotation of the disc 12 substantially along the line of trajectory of a chip that just misses the leading roll. These abuttments 202, 204, 206, 208, 210, etc. divide an annular area on the face 18 equivalent to the annular area of the disc 12 that forms the nips 22 with the rolls 20 into inlet sections indicated at 212, 214, 216, 218, and 220 etc each leading into a roll 20 and trailing or exit sections 222, 224, 226, 228 and 230 etc each positioned on the exit side of its respective roll 20. The exits sections provide free passages to the periphery of the disc 12 for chips after they have been crushed. This arrangement substantially ensures that all the chips pass through only one nip 22. It also ensures that if the trajectory of some chips would carry them on between a pair of rolls they are prevented from leaving the disc 12 without passing through on nip 22 unless they are smaller than the minimum thickness chip to be processed. In the later case the small chip may escape through the channel between the edges of the abuttment 202, 204 etc and the face 12 of the disc 12.

The abuttments 202, 204, 206, 208, 210 etc need not extend the full distance between a pair of rolls, but must extend forward from the rearward roll i.e. the abuttment 206 must extend forward from the roll designated 20D to define at least part of the lead in section 216.

The operation of the FIGS. 7 to 9 inclusive embodiment is similar to that of the FIGS. 1 – 3 embodiment the difference being that the chips are not trapped by the sloping top wall of the gap but rather follow their free trajectory into the nips 22 and after passing through the nips 22 are released into the exit areas 222, 224, 226, 228, 230, etc. and simply pass off the disc 12 and are propelled by the blades 36 through the exit 38. The spacing between the faces 16 & 18 in the areas 222, 224, 226, 228, 230 etc is sufficient to accomodate expansion of the chips after they are compressed and permit the crushed chips to leave the disc 12.

It will be apparent that the crusher of the instant invention may be provided with means for engaging the chips and controlling the movement of the chips through the device, i.e. the sloping of the gap of the FIGS. 1 to 3 embodiment and the abuttments of the FIGS. 7 to 9 embodiments or alternatively the trajectories may be adjusted to ensure that they pass to at least one of the nips 22 by correlation of the speed of rotation of the flinger 28 (if provided) and the disc 12. Generally even when the abuttment means are used the trajectories will be regulated to obtain the desired flow of chips through the nips 22.

The arrangement shown in FIG. 4 with the rolls 20 set at an angle may be used with any of the other embodiments disclosed.

Also if abuttments are desired such as the tapering gap 30 or the abuttments 202, 204, etc. other abuttments may be substituted, for example, the gap 30 instead of being tapering may be stepped or there may simply be one relatively large step at the outer periphery of the gap or flanges may be provided at the outer ends of the rolls 20. Generally no abuttments will be necessary and the device will take on the configuration similar to that shown in FIGS. 5 and 6 wherein the gap 100 in the working area 102 has no means to impede the movement of the chips towards the outer periphery of the disc 12.

The discs 12 have been illustrated with the annular working surfaces 16 that co-operate with the rolls 20 and 20' substantially perpendicular to the axis of rotation of the disc. These surfaces 16 may be conical. If a conical working surface 16 is used, care must be taken not to disrupt the trajector of the chips to the extent that the device becomes substantially ineffective, i.e. the chips must be able to easily slide through the gap between the working surface 16 of the disc 12 and the inner surface 18 of the housing 10.

The crusher is disclosed specifically for the treatment of wood chips, however other materials such as soft stone or shale may also be crushed.

Modifications may be made without departing from the spirit of the invention as defined in the amended claims.

I claim:

1. A crusher comprising a disc, means to rotate said disc on an axis, said disc having a working surface, a housing enclosing said disc, an inlet in said housing for feeding chips to said disc adjacent said axis, an outlet from said housing, at least one roll mounted for rotation on its longitudinal axis, said roll cooperating with an annular area of said working surface to form a nip, the surface of said roll and said annular area being substantially parallel in said nip, means to fling said chips radially outward of said disc whereby to spread said chips in a substantially single thickness layer of said chips and to introduce said chips into said nip.

2. A crusher as defined in claim 1 wherein a plurality of said rolls are provided on said housing.

3. A chip crusher as defined in claim 2 wherein said means to fling comprises a flinger and rotatable on said axis of said disc and means to rotate said flinger.

4. A chip crusher as defined in claim 2 wherein said means to fling comprises a surface on said disc.

5. A crusher as defined in claim 4 wherein said rolls are substantially cylindrical and are between about 1 and 10 inches in diameter.

6. A chip crusher as defined in claim 4 wherein said rolls have a diameter of between 3 and 5 inches.

7. A chip crusher as defined in claim 2 wherein a tapering gap is provided between said working surface and said housing; said tapering gap having a height adjacent the end of said rolls closest said axis substantially equal but slightly larger than a maximum thickness chip to be processed and a minimum height adjacent the ends of said rolls remote from said axis substantially equal to the height of said nip.

8. A crusher as defined in claim 7 wherein said axis of rotation of each of said rolls is substantially radial relative to said axis of rotation of said disc.

9. A chip crusher as defined in claim 7 further comprising projection extending from said working surface of said disc and adapted to force chips through said nips.

10. A chip crusher as defined in claim 7 further comprising means for driving each of said rolls thereby tend to induce chips to pass through said nips.

11. A chip crusher as defined in claim 7 further comprising breaker bars projecting from said housing toward said working surface of said disc.

12. A chip crusher as defined in claim 7 wherein said rolls are conical.

13. A chip crusher as defined in claim 2 further comprising abuttment means between successive rolls said abuttment means extending at least partway along a line extending from adjacent the end of a leading one of said rolls closest to the axis of rotation of said disc to the end of the next following roll remote from said axis of rotation of said disc, one end of said abuttment means being adjacent said following roll, said abuttment means projecting from said plate means towards said disc.

14. A crusher as defined in claim 2 wherein said axis of rotation of each of said rolls is substantially radial relative to said axis of rotation of said disc.

15. A chip crusher as defined in claim 2 further comprising projections extending from said working surface of said disc and adapted to force chips through said nips.

16. A chip crusher as defined in claim 2 further comprising means for driving each of said rolls thereby tend to induce chips to pass through said nips.

17. A chip crusher as defined in claim 2 further comprising breaker bars projecting from said housing toward said working surface of said disc.

18. A chip crusher as defined in claim 2 wherein said rolls are conical.

* * * * *

UNITED STATES PATENT OFFICE

CERTIFICATE OF CORRECTION

Patent No. 3,962,966 Dated June 15, 1976

Inventor(s) Joseph A. LaPointe

It is certified that error appears in the above-identified patent and that said Letters Patent are hereby corrected as shown below:

On the Title Page insert:

-- [30] Foreign Application Priority Data

Canada 217786 Jan. 13, 1975 --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*